US005730646A

United States Patent [19]

Watkin

[11] Patent Number: 5,730,646

[45] Date of Patent: Mar. 24, 1998

[54] OSCILLATING BLAST CLEANER

[75] Inventor: Robert B. Watkin, Peachtree City, Ga.

[73] Assignee: United States Filter Corporation, Palm Desert, Calif.

[21] Appl. No.: 730,162

[22] Filed: Oct. 15, 1996

Related U.S. Application Data

[63] Continuation of Ser. No. 255,386, Jun. 8, 1994, abandoned, which is a continuation-in-part of Ser. No. 183,194, Jan. 14, 1994, abandoned.

[51] Int. Cl.[6] ..... B24C 3/06

[52] U.S. Cl. ..... 451/92; 451/2

[58] Field of Search ..... 451/2, 3, 75, 87–89, 451/92

[56] References Cited

U.S. PATENT DOCUMENTS

| | | | |
|---|---|---|---|
| 1,342,488 | 6/1920 | Woods . | |
| 2,118,276 | 5/1938 | Temple . | |
| 3,566,543 | 3/1971 | Fogle . | |
| 3,864,876 | 2/1975 | Diehn . | |
| 3,872,625 | 3/1975 | Fuma et al. . | |
| 3,900,969 | 8/1975 | Diehn | 451/87 |
| 3,934,373 | 1/1976 | Leliaett et al. | 451/92 |
| 3,984,944 | 10/1976 | Maasberg et al. . | |
| 4,020,596 | 5/1977 | Bergh . | |
| 4,092,942 | 6/1978 | Kurohiji et al. . | |
| 4,149,345 | 4/1979 | Atsuchi . | |
| 4,199,905 | 4/1980 | Neidigh et al. . | |
| 4,319,436 | 3/1982 | Von Fossen . | |
| 4,433,511 | 2/1984 | Swain . | |
| 4,860,400 | 8/1989 | Urakami . | |
| 4,926,957 | 5/1990 | Urakami . | |
| 5,231,836 | 8/1993 | Swain | 451/92 |
| 5,285,601 | 2/1994 | Watkin et al. . | |
| 5,291,697 | 3/1994 | Nelson | 451/92 |

*Primary Examiner*—Timothy V. Eley

*Attorney, Agent, or Firm*—Wolf, Greenfield & Sacks, P.C.

[57] ABSTRACT

The cleaning apparatus of the invention consists of a blast machine mounted on a support structure for oscillating motion relative thereto. In one embodiment, the blast machine consists of a blast wheel for projecting abrasive onto the surface, a hopper for collecting the spent abrasive and debris, a screw conveyor for returning the spent abrasive and debris to a separator where the debris is separated from the abrasive and the abrasive is returned to the blast wheel. The support structure is supported against the surface being cleaned on sleds or wheels. On a vertical surface the cleaning apparatus is raised by a winch and on a horizontal surface the wheels can be power driven. The blast machine is arranged with its axis of rotation perpendicular to the path of travel of the apparatus and is simultaneously oscillated relative to the support structure in a direction perpendicular to the path of travel of the support structure by a fluid cylinder and cable arrangement. As a result, the blast machine is able to clean or otherwise treat a path as wide as the range of oscillation with minimum overlap of adjacent paths.

12 Claims, 8 Drawing Sheets

OSCILLATING BLAST CLEANER

This application is a continuation of application Ser. No. 08/255,386, filed on Jun. 8, 1994, now abandoned, which is a continuation in part of Ser. No. 08/183,194 filed on Jan. 14, 1994, now abandoned.

BACKGROUND OF THE INVENTION

The invention relates, generally, to surface treating machines and, more particularly, to an improved blast machine for cleaning substantially vertical surfaces.

It is often necessary to clean or otherwise treat large substantially vertical surfaces such as ship hulls, large storage tanks and the like. Numerous efforts have been made in this area to design a machine that can be secured to these vertical surfaces in a manner that allows the machine to traverse the surface while cleaning or otherwise treating the surface. The problems inherent in supporting a large machine on a vertical surface, however, have caused these efforts to be mostly unsuccessful as these machines have been too large, cumbersome, expensive and inefficient to be commercially successful.

One problem associated with such devices is that the surfaces over which they must travel are not smooth, uniform surfaces. As will be appreciated, the surfaces of ship hulls and large storage tanks include projections and obstructions that prevent large machines from reaching corners, crevices and other hard to reach areas. Moreover, these projections may make it difficult for devices that rely on magnets or suction to adhere to the surface.

A second problem is encountered specifically with large storage tanks that are found at refineries, depots and other similar facilities and are used to store gasoline, oil and the like. It is necessary to periodically clean or otherwise treat the inside as well as the outside of these structures. Access to the interior of these structures, however, is limited to a substantially two foot diameter door. As a result, large machines, typically used to clean the exterior of these structures, cannot fit through the door such that the interior of the tanks must be cleaned by hand using a scaffold specifically designed for use in the interior of these tanks. As will be appreciated, the hand cleaning process is extremely slow and labor intensive and can be dangerous to those working on the inside of the tank.

Moreover, it will be appreciated that a typical blast wheel cleans a substantially rectangular area that is approximately the width of the blast wheel. At the upper and lower edges of the cleaned area the density of the shot impacting the surface is less than at the center portion of the cleaned area that is directly below the blast wheel. As a result, the upper and lower edges of the cleaned portion are not cleaned as thoroughly as the center portion. This phenomena is known as "fanning".

Because of the cleaning characteristics of a blast wheel, the traditional methods of moving a blast wheel over the surface produce undesirable results. For example, where the axis of rotation of the blast wheel is arranged perpendicular to the direction of travel, only a very narrow band (i.e., the approximate width of the blast wheel) of surface can be cleaned. Where the axis of rotation of the blast wheel is arranged parallel to the direction of travel of the blast wheel over the surface, a much wider band of surface can be cleaned; however, the edges of this band are "fanned" (i.e., not thoroughly blast cleaned). As a result, it is necessary to overlap adjacent bands extensively to achieve complete cleaning. As will be apparent, both of these situations are inefficient.

Thus, an improved surface treating apparatus that can efficiently clean large surfaces is desired.

SUMMARY OF THE INVENTION

The cleaning apparatus of the invention consists of a blast machine mounted on a support structure for oscillating motion relative thereto. In one embodiment, the blast machine consists of a blast wheel for projecting abrasive onto the surface, a hopper for collecting the spent abrasive and debris, a screw conveyor for returning the spent abrasive and debris to a separator where the debris is separated from the abrasive and the abrasive is returned to the blast wheel. The support structure is supported against the surface being cleaned on sleds or wheels. On a vertical surface the cleaning apparatus is raised by a winch and on a horizontal surface the wheels can be power driven. The blast machine is arranged with its axis of rotation perpendicular to the path of travel of the apparatus and is simultaneously oscillated relative to the support structure in a direction perpendicular to the path of travel of the support structure by a fluid cylinder and cable arrangement. As a result, the blast machine is able to clean or otherwise treat a path as wide as the range of oscillation with minimum overlap of adjacent paths. Finally, the components of the apparatus are designed to be removable such that the apparatus can be quickly and easily broken down to a size small enough to fit through small passages such as those found on storage tanks and the like.

DETAILED DESCRIPTION OF THE INVENTION

Figure 1:
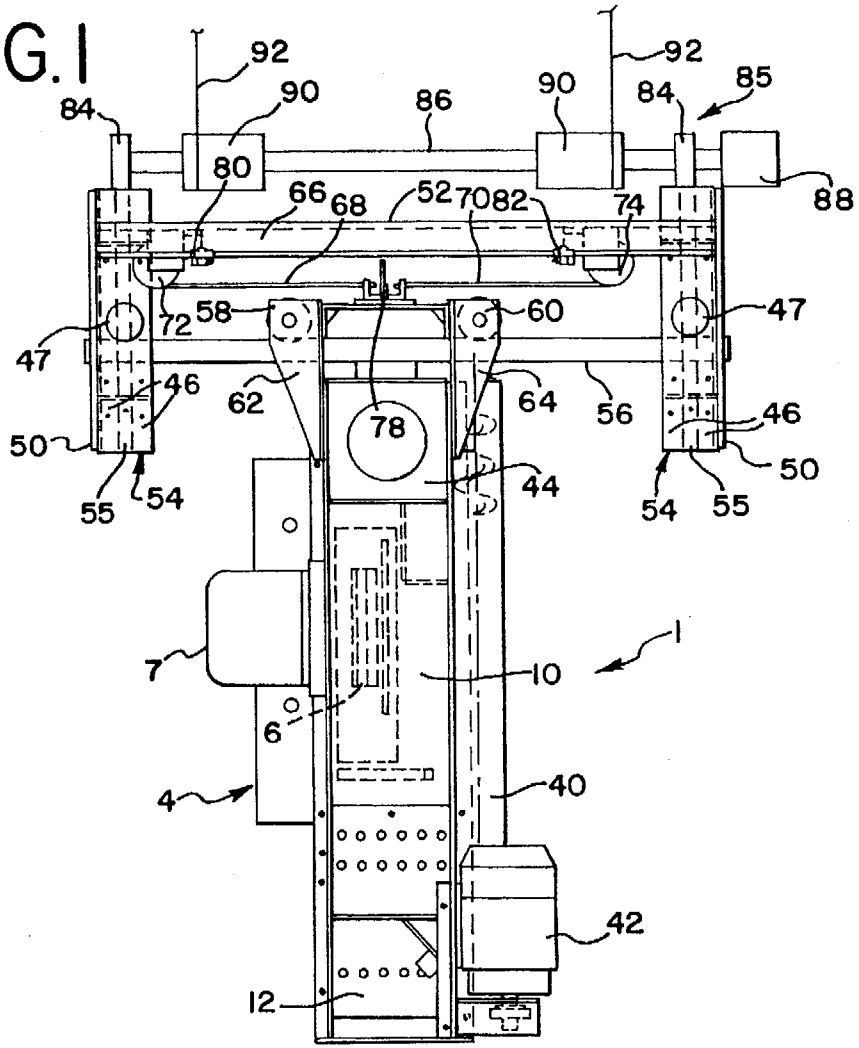
FIG. 1 is a front view of one embodiment of the apparatus of the invention suspended on a vertical surface.
Figure 2:
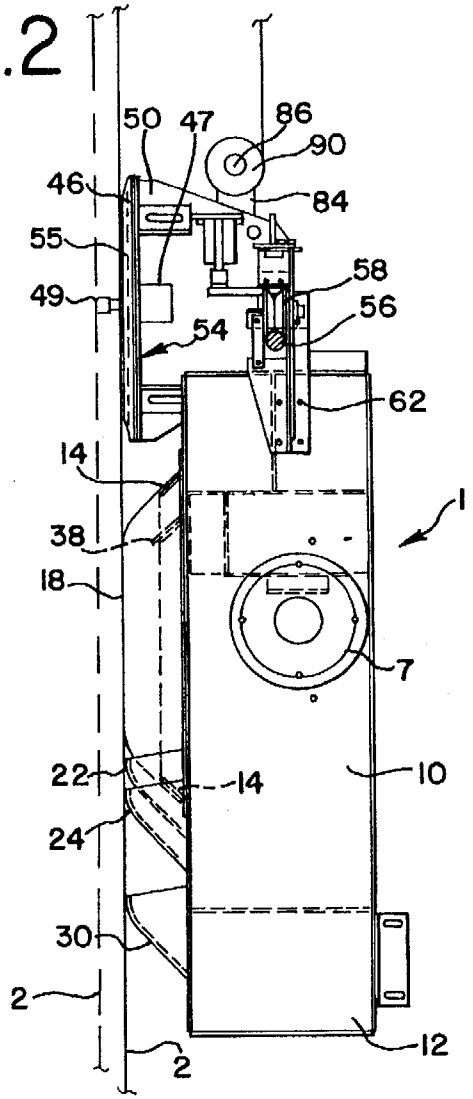
FIG. 2 is a side view of the apparatus of FIG. 1 suspended on a vertical surface.

Referring more particularly to FIGS. 1 and 2, a preferred embodiment of the cleaning apparatus of the invention is shown generally at 1 suspended against a substantially vertical surface 2 such as a ship hull or storage tank. The cleaning apparatus 1 includes a blast unit 4 consisting of a blast wheel 6 for projecting abrasive against surface 2. Blast wheel 6 is rotated at high speed by electric motor 7 and projects the abrasive through a blast chamber formed in the blast machine housing 10 as will be understood by one skilled in the art.

A hopper 12 is mounted to the underside of housing 10 to collect the spent abrasive and debris after the abrasive impacts surface 2. As will be appreciated, the abrasive strikes the surface 2 with sufficient kinetic energy to cause it to rebound from the surface and into hopper 12.

Figure 3:
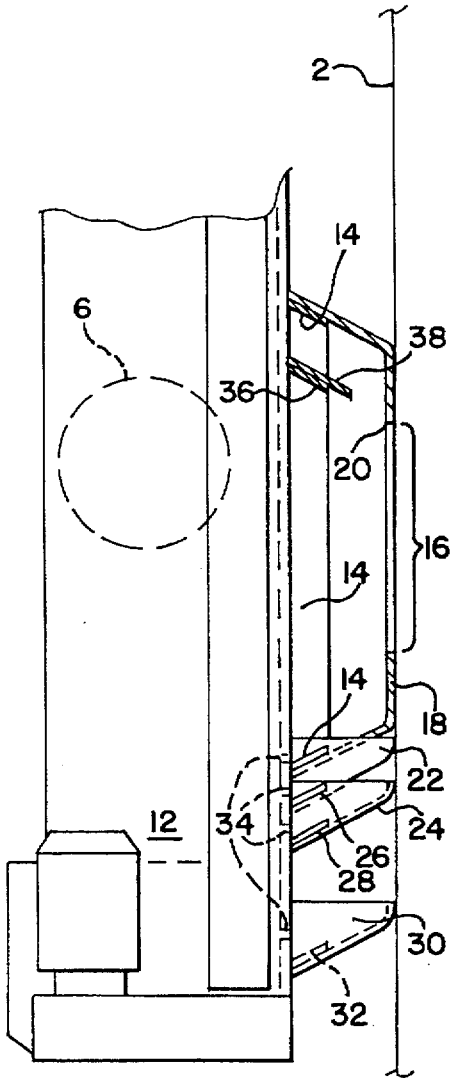
FIG. 3 is a detailed side view showing the sealing arrangement of the invention.

To prevent the escape of abrasive and debris from the blast zone a seal arrangement is provided as best shown in FIGS. 2 and 3. Specifically, four baffles 14 extend from housing 10 to define a rectangular chamber surrounding blast zone 16. A resilient seal 18 is mounted over baffles 14 which contacts surface 2 to prevent the escape of abrasive and debris. Seal 18 consists of a square of flexible material secured to the baffles 14 at its periphery and having an aperture 20 formed centrally therein. Seal 18 contacts the surface 2 with aperture 20 disposed over the blast zone 16 such that the abrasive thrown by wheel 6 can contact the surface but the spent abrasive and debris are prevented from escaping the blast zone.

A second flexible seal 22 and third flexible seal 24 are mounted to baffles 26 and 28, respectively, below and partially surrounding seal 18. Seals 22 and 24 trap abrasive that may escape seal 18. An additional flexible seal 30 is mounted on baffle 32 below seal 24 to collect any abrasive that may escape seals 22 and 24. Holes 34 are formed in the housing to communicate the areas enclosed by the seals to the hopper 12 such that the abrasive collected by seals 18, 22, 24 and 30 will drain into hopper 12. An additional baffle 36 and seal 38 are mounted inside of seal 18 above the blast zone to direct stray abrasive and debris downward toward holes 34.

Referring again to FIGS. 1 and 2, the blast unit further includes a screw conveyor 40 that is driven by motor 42. Screw conveyor 40 removes the spent abrasive and debris from the hopper 12 and delivers it to separator 44. Separator 44 can have any suitable construction that allows the abrasive to be separated from the debris and that delivers the abrasive back to wheel 6 as is known in the art.

A support structure or carriage 48 supports blast unit 4 on surface 2 and consists of a pair of side plates 50 connected by a cross member 52. Each side plate 50 is supported on a sled 54 that rides on and slides over surface 2. Each sled 54 includes a strip of high molecular weight plastic 55 that contacts and slides over surface 2. Located on either side of strip 55 are permanent magnets 46. Magnets 46 magnetically attract surface 2 to prevent the apparatus from swinging as it traverses the vertical surface.

When the apparatus reaches the end of its vertical path of travel, either at the top or bottom of surface 2, the apparatus is moved horizontally as will hereinafter be described. Before it is moved horizontally, however, the magnets 46 must be removed from magnetic engagement with surface 2. Accordingly, an air cylinder 47 is arranged on each sled 54 such that its reciprocating piston 49 extends perpendicularly to surface 2. When piston 49 is retracted the apparatus will be arranged with the surface 2 in the solid line position (FIG. 2) where sled 54 and seals 18, 22, 24 and 30 are in contact with the surface. In this position the blast cleaning operation is conducted. When plunger 49 is extended as shown in FIG. 2, the apparatus is moved away from surface 2 such that there is a gap between the apparatus and surface 2, shown in dashed line in FIG. 2. In this position, the apparatus can be moved horizontally without resistance from the magnetic attraction between magnets 46 and surface 2.

Also extending between side plates 50 is an elongated cylindrical rail 56. Rail 56 supports the blast unit in a suspended manner via pulley wheels 58 and 60 that are freely rotatable in yokes 62 and 64 which, in turn, are fixed to the blast unit 4. The pulley wheels 58 and 60 simply ride on rail 56 such that the blast unit 4 can be separated from support structure 48 merely by lifting wheels 58 and 60 from rail 56.

Mounted to cross member 52 is the drive system for oscillating the blast unit 4 relative to the support structure 48. The drive system consists of a fluid cylinder 66 fixed to cross member 52. Flexible transmission members or cables 68 and 70 are reeved around pulleys 72 and 74 and are connected at their one end to the opposite sides of the movable piston (not shown) of cylinder 66 and at their opposite ends to flange 78 that is fixed to blast unit 4 via yokes 62 and 64. As a result, when the piston of cylinder 66 is reciprocated by alternately pressurizing the chambers on opposite sides of the piston, the transmission members 68 and 70 will transmit the reciprocating motion to blast unit 4. Such cable/cylinder drives are commercially available.

When cylinder 66 is activated, the blast unit 4 will be oscillated left and right as viewed in FIG. 1 as the wheels 58 and 60 ride on rail 56. Switches 80 and 82 can be mounted on cross member 52 at any suitable position to be contacted by flange 78 thereby to control the pressurization of cylinder 66 and the width of the path traversed by the oscillating blast unit. While the cable/cylinder drive is shown, it is to be understood that other suitable oscillating drive mechanisms could be used if desired.

To raise and lower apparatus 1, a winch 85 is mounted to the top of the apparatus. Specifically, a pair of bearing blocks 84 rotatably support shaft 86. Shaft 86 is rotatably driven by variable speed reversible motor 88 and supports a pair of cable drums 90. Cables 92 have their first ends connected to and reaved around drums 90 and have their opposite ends secured to the top of the surface being cleaned by any suitable support mechanism as will hereinafter be described. By actuating motor 88, shaft 86 is rotated to wind and unwind cables 92 on cable drums 90 thereby to raise and lower the entire apparatus.

Figure 4:
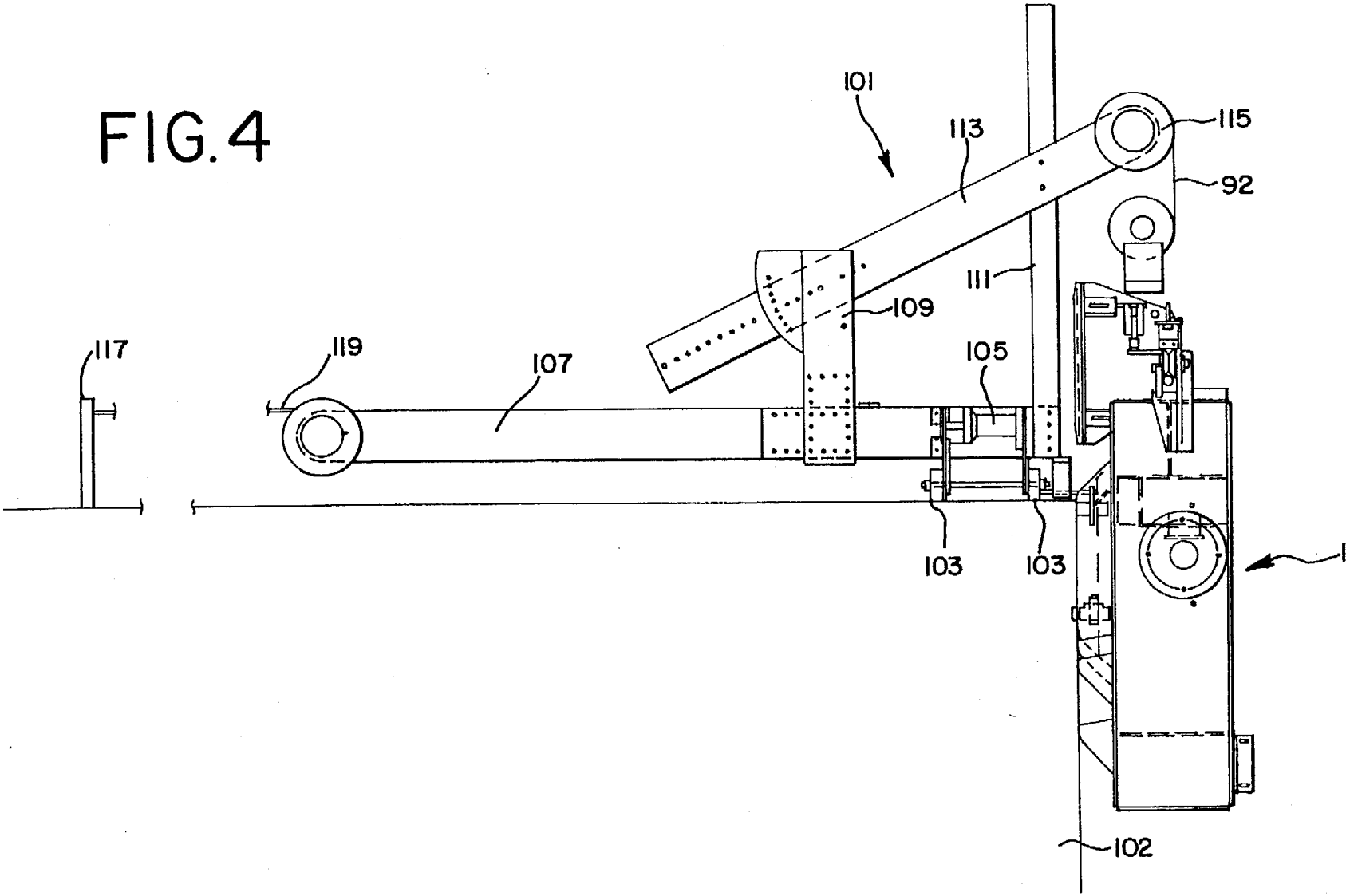
FIGS. 4 and 5 are side views, showing the system for supporting the apparatus of FIG. 1 on a vertical surface.
Figure 5:
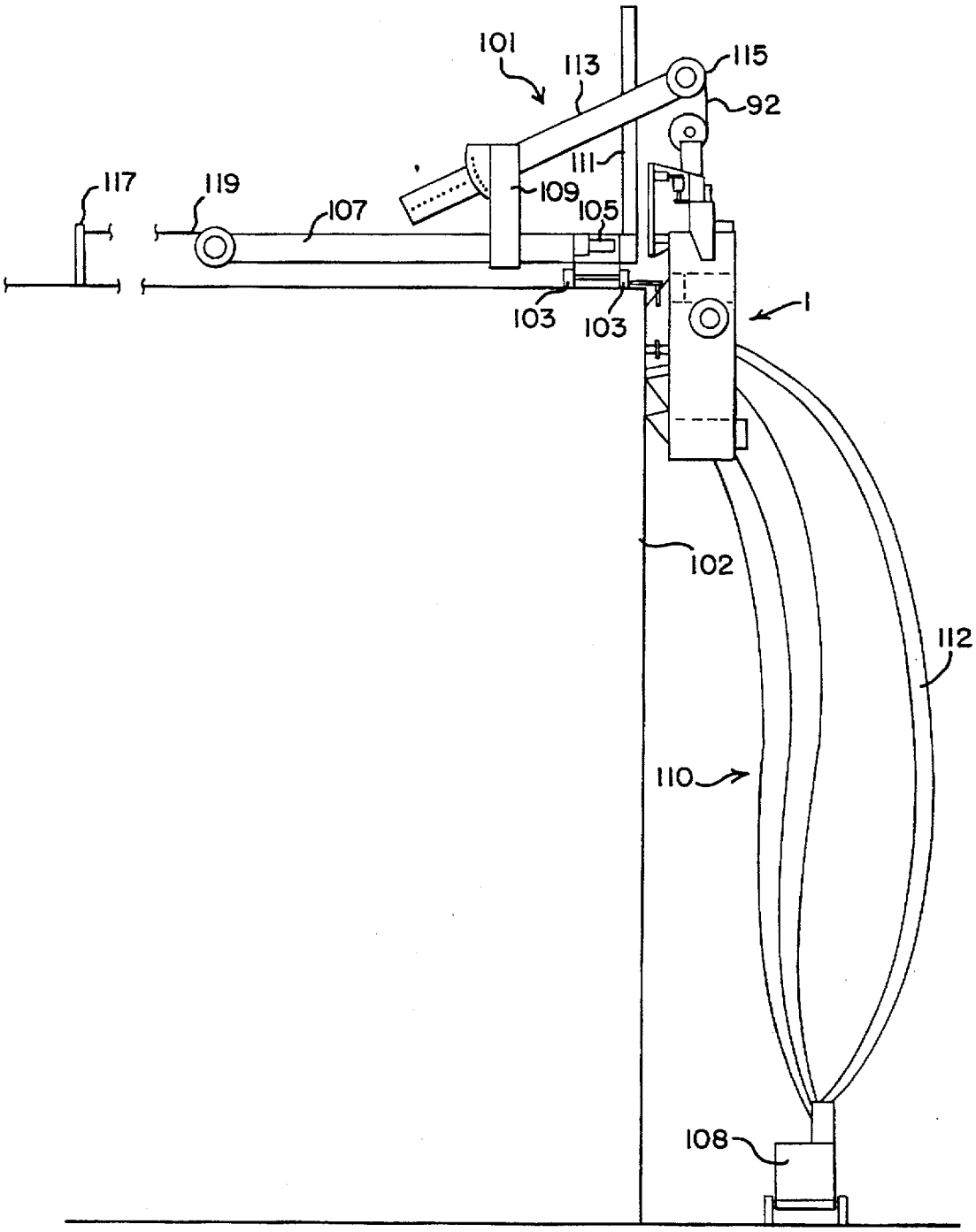

Referring to FIGS. 4 and 5, a preferred support structure is illustrated for supporting the apparatus on a storage tank. The support structure includes a relatively small fixture 101 located on the top of the tank 102. Fixture 101 includes four wheels 103 (two of which are shown) that ride on the top of tank 102. Wheels 103 are driven by a hydraulic motor 105 or other suitable drive mechanism. The wheels 103 carry a support structure consisting of a horizontal arm 107 supporting a first vertical support 109 and a second vertical support 111. A pair of support arms 113 are supported by vertical supports 109 and 111 (only one of which is visible in FIG. 4) and has their ends 115 extending over the edge of the vertical surface and connected to the ends of cables 92 thereby to support apparatus 1 on surface 2. The fixture 101 is dimensioned and constructed such that it counterbalances the weight of apparatus 1. The position of vertical support 109 and support arm 113 can be made adjustable to accommodate vertical tanks or other structures having different configurations. Moreover, for tanks having different constructions the arrangement of fixture 101 can be modified so long as it is capable of traversing the surface and counterbalancing or supporting the weight of apparatus 1.

The fixture 101 is supported on tank 102 by a tether arrangement. The typical storage tank includes a post 117 mounted in the center thereof. A cable 119 connects arm 107 to the post 117. Thus, when wheels 103 are driven by motor 105, support 101 will circle about the periphery of tank 102 on tether 119.

A cart 108 is positioned on the ground and carries the power and remote control system for controlling the fluid cylinder 66, motor 42, motor 88, motor 7 and motor 105. In the preferred embodiment, these drive mechanisms can be hydraulically operated where a compressor located on cart 108 drives all of the motors via hydraulic lines 110 or remotely controlled electric motors. It will be appreciated that other remote controlled drive systems can be used if desired.

Cart 108 can also carry a dust collector that is connected to separator 44 of apparatus 1 via hose 112. Hose 112 pulls air through separator 44 to separate the abrasive from the debris in an air wash system as will be appreciated by one skilled in the art.

Figure 6:
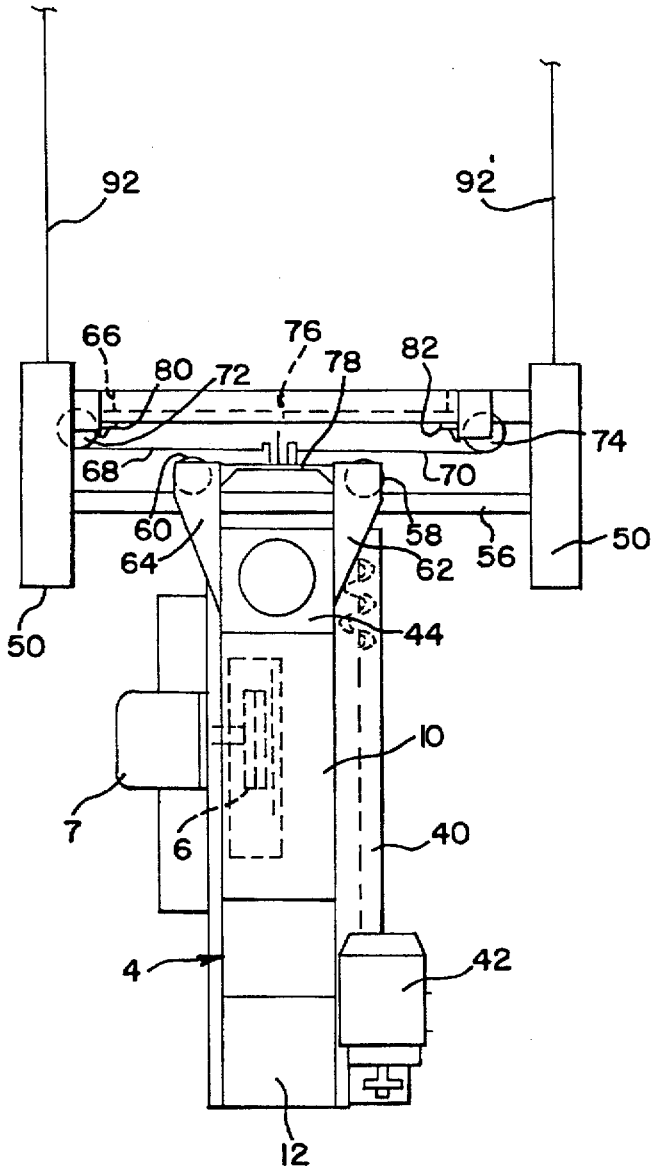
FIG. 6 is a front view of an alternate embodiment of the invention.
Figure 7:
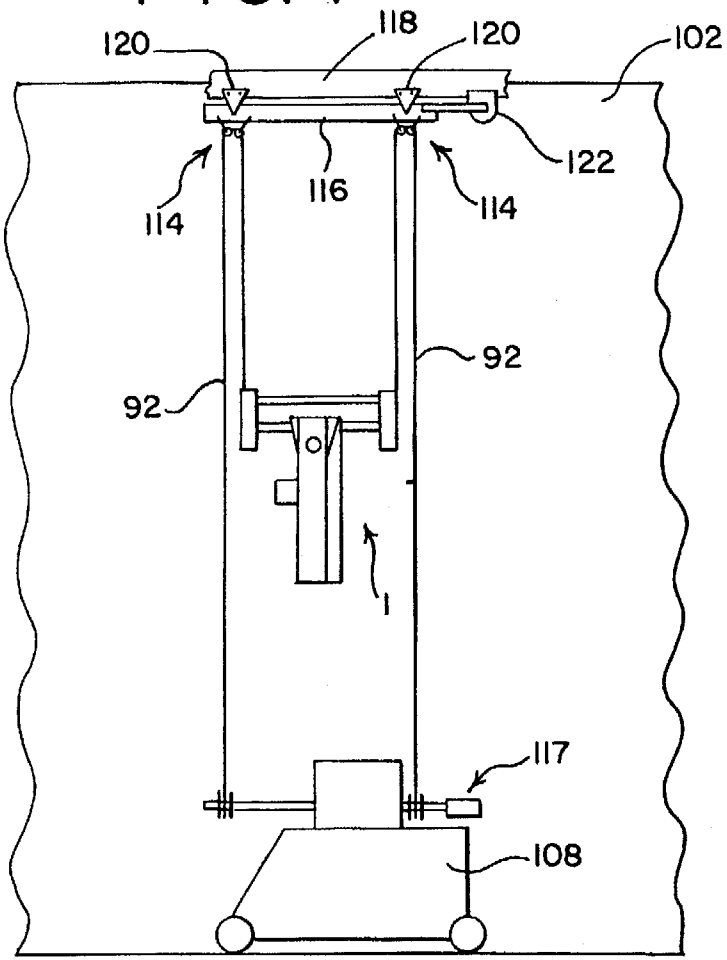

An alternate embodiment of apparatus 1 is illustrated in FIG. 6 where like numerals are used to identify like components of the preferred embodiment illustrated in FIG. 1. Eliminated from the embodiment of FIG. 7 is the winch such that cables 92 are connected directly to side plates 50. In this embodiment cables 92 are reaved around pulley wheel assemblies 114 supported on the top of ship hull or tank 102 on beam 116 as best shown in FIGS. 7 and 8.

The opposite ends of cables 92 are connected to a winch 117 that is supported on the movable cart 108. The cart 108 is weighted such that it is heavier than the apparatus 1 and can support the apparatus on the vertical surface 2. The winch 117 is driven to slowly wind and unwind the cables 92 thereby to raise and lower the entire apparatus 1 over the surface 2. The cart 108 also supports the controls for driving the various motors via hydraulic or electric lines as previously described with respect to FIGS. 4 and 5.

Figure 8:
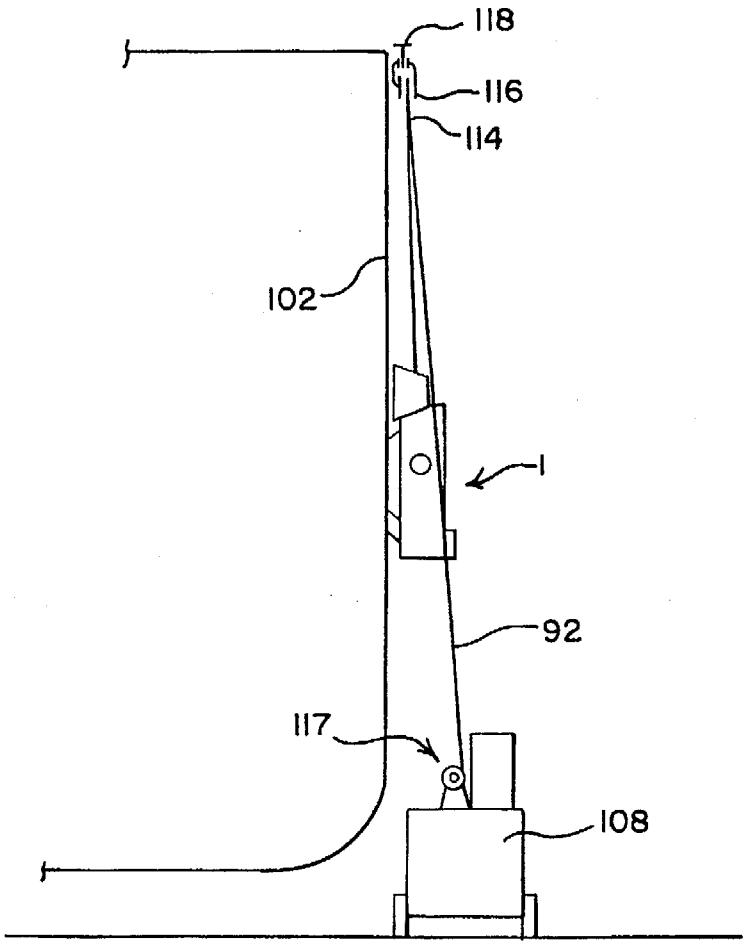
FIGS. 7 and 8 are front and side views, respectively, showing an alternate system for supporting the apparatus of the invention.

As shown in FIGS. 7 and 8 beam 116 is supported on a relatively larger beam 118 on wheel assemblies 120 such that beam 116 can reciprocate relative to beam 118 in a horizontal direction. Beam 118 is supported on the top of the surface 2 by any suitable means such as fixture 101 as described with reference to FIGS. 4 and 5 or a boom arm as will hereinafter be described with reference to FIGS. 9 through 12. A traction drive 122, also controllable from the ground, moves beam 116 relative to beam 118. As a result, the blast machine 1 can be moved laterally over surface 2 after each vertical pass of machine 1 by actuating drive 122.

While in the illustrated embodiment beam 116 is supported by beam 118, it is to be understood that beam 116 could be supported directly by fixture 101 (or other support mechanism) and beam 118 eliminated. With such a configuration beam 116 would be stationary and would be moved by support 101, boom arm or other support after each vertical pass of machine 1.

Another preferred support structure for the apparatus 1 will now be described with reference to FIGS. 9 through 12. Beam 116 is shown supported adjacent surface 2 by a boom 124 mounted on truck 126. While a boom is illustrated it will be appreciated that the apparatus 1 could be supported on a JLG or "spider" where the operator is situated in a cage located at the end of the boom arm at the top of the surface being cleaned. Any structure that can suspend the apparatus 1 from a position above the surface being cleaned can be used. Because the apparatus 1 is raised and lowered by cables 92 which are mounted to beam 116, the beam 116 must be supported in a horizontal position regardless of the inclination of boom 124 in order to allow the machine to traverse the surface properly. When a JLG or spider is used as the support, the beam 116 is supported by the operator's cage and will be maintained in a horizontal orientation because the orientation of the cage is automatically maintained.

To maintain the horizontal orientation of beam 116 when a boom is used as the support, the support structure 128 is used. The support structure 128 includes a clamp 130 for fixing the support to the boom 124. The clamp 130 consists of two plates 132, 134 that surround the boom and are fixed together by fasteners such as bolts with the boom clamped therebetween. A pivot arm 138 is pivotally connected to plates 132, 134 by pin 140 such that arm 138 can pivot about a horizontal axis relative to boom 124.

The cable 142 of the boom arm is reaved around pulleys 144 at the end of boom 124 and is connected to arm 138. The winding and unwinding of cable 142 will cause arm 138 to pivot relative to boom 124. Thus, as the inclination of boom 124 changes, the arm 138 can be maintained in the illustrated horizontal position by winding or unwinding cable 142 as required.

Figure 9:
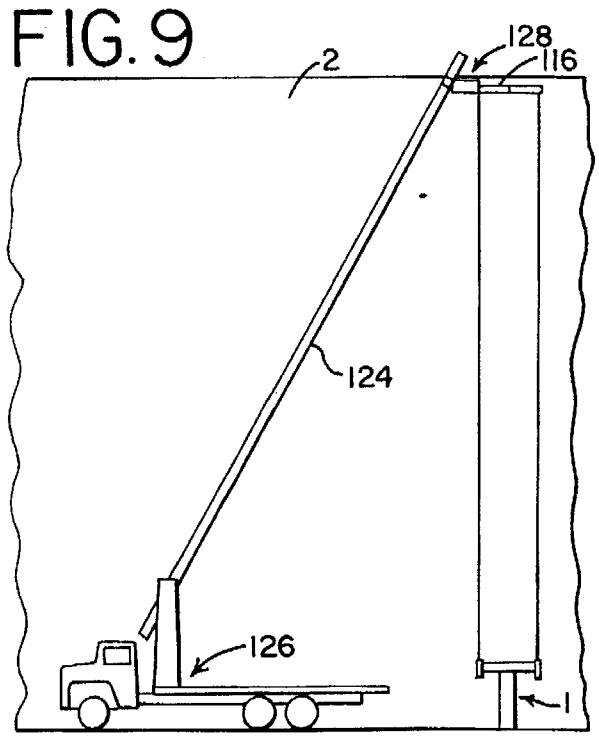
FIG. 9 is a front view showing the system supported on a vertical surface by a boom.

Arm 138 carries the beam 116 that supports the blast machine. While in the illustrated embodiment arm 138 is supporting beam 116, it will be appreciated that arm 138 could support beam 118 and beam 118 support beam 116 as described with reference to FIG. 7. In either case the beam is supported on pin 140 such that it can pivot about a vertical axis relative to arm 138. This pivoting motion allows the beam to be positioned substantially parallel to the surface being cleaned regardless of the angle at which the boom 124 approaches the surface. As a result, the beam will be oriented so as to suspend the machine as shown in FIG. 9.

In another embodiment, the apparatus of FIG. 7 can be supported on the fixture 101 as illustrated in FIGS. 4 and 5. In such an embodiment, the winch 85 is mounted on the end of support arm 113 rather than on apparatus 1. The operation of the device will proceed as in the preferred embodiment except that vertical movement of the apparatus will be provided by the winch mounted to fixture 101.

As the apparatus is raised, a vertical swath of surface 2 is cleaned that is as wide as the range of oscillation of blast machine 4 where the edges of the cleaned surface are clearly demarked without the effects of fanning. Once the apparatus reaches the top of surface 2, support 101 is moved around the tank or beam 116 is moved along the surface 2 by a boom arm, JLG or other support mechanism a distance equal to the width of the cleaned strip and the apparatus is lowered. This process is repeated until the entire surface is cleaned.

The support structure 48 can be separated from the blast unit 4 by simply lifting pulley wheels 58 and 60 from rail 56 to break the apparatus down to a size where it can fit through the small door in the storage tank. Additionally, the drive motors 7 and 42 and the screw conveyor 40 and the bar magnets 46 can also be removed from the unit to further reduce its size if desired. The device can be quickly and easily reassembled on the interior of the tank.

Figure 13:
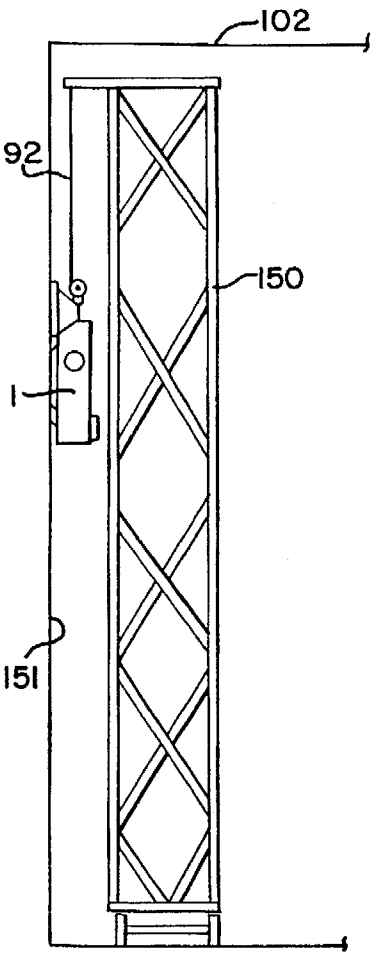
FIG. 13 is a side view showing the apparatus of the invention supported on a scaffold.
Figure 10:
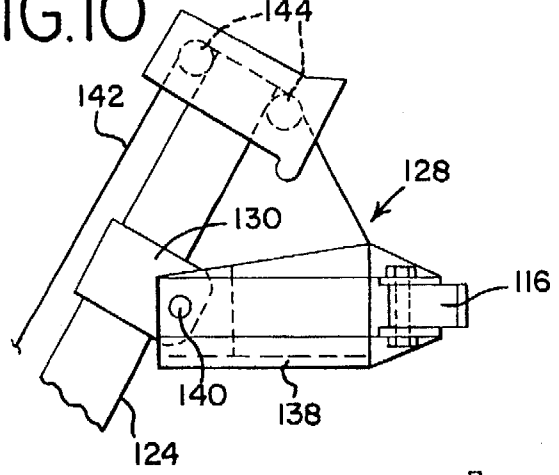
FIGS. 10, 11 and 12 are detailed views showing the support apparatus for use with a boom.
Figure 11:
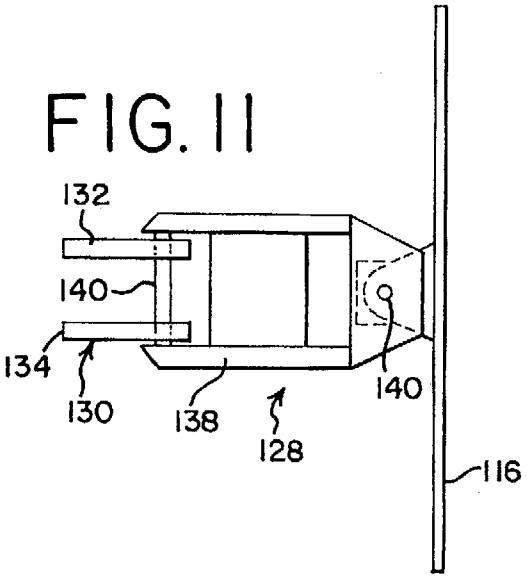
Figure 12:
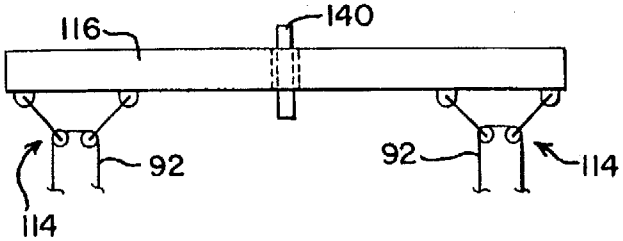

Referring to FIG. 13, to clean the interior of a storage tank, the cables 92 are suspended from the top of the scaffolding 150 that is presently used for hand cleaning the interior of the tank 102 such that the apparatus 1 rest against the inside wall 151. The interior surface can then be cleaned by simply moving the scaffolding around the interior of the tank. It should be noted that the scaffolding support arrangement can be used on the exterior of the ship or tank as well as on the interior of the tank, if desired.

It will be appreciated that the winch for moving the apparatus vertically can be mounted on the apparatus as shown in FIGS. 4 and 5, on the fixture as shown in FIGS. 7 and 8 or on the support at the top of the surface being cleaned (not shown). Moreover, with the winch located in any one of these positions, the apparatus can be supported by the support of FIGS. 4 and 5, the support beams of FIGS. 7 and 8, the boom truck or JLG of FIG. 9 or any other suitable support. Moreover, the support beams of FIGS. 7 and 8 could be used with the support of FIGS. 4 and 5, with the boom truck or JLG of FIG. 9 or with another support mechanism. Finally, the scaffolding shown in FIG. 13 can be used in place of the supports of FIGS. 4, 5, 7, 8 and 9 with the winch mounted to the scaffolding, the apparatus 1 or the cart 108. As will be appreciated, the support for the apparatus can have a variety of configurations provided it can move the apparatus vertically and horizontally over the surface. Moreover, carriage 48 could carry surface cleaning apparatuses other than the blast unit. For example, the blast unit could be replaced by scrubbing brushes or a painting unit if desired.

Figure 14:
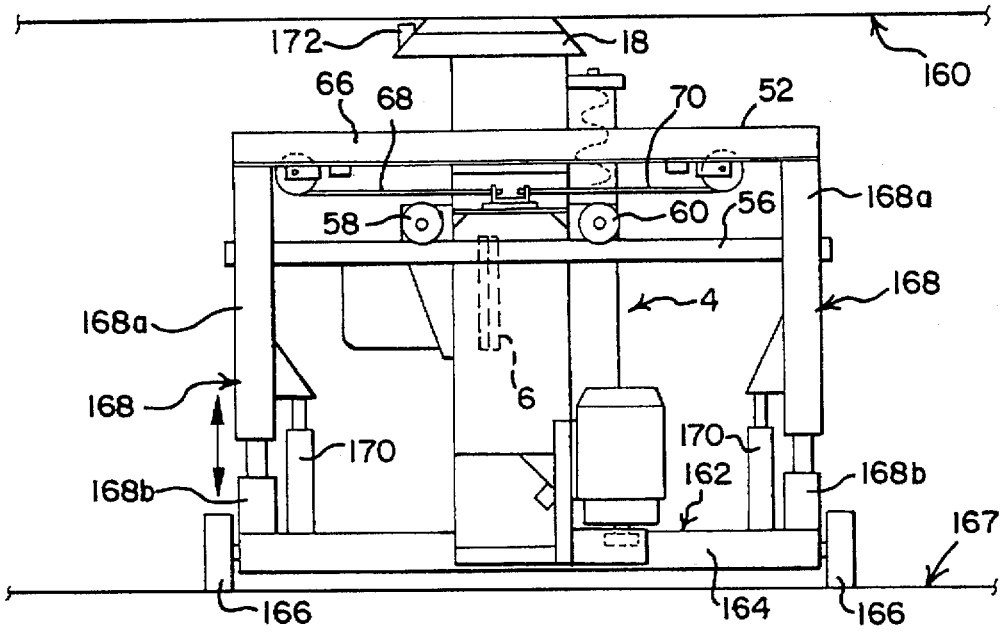
FIG. 14 is a front view of another embodiment of the apparatus of the invention.

Referring more particularly to FIG. 14, an alternate embodiment for supporting the blast unit 4 adjacent the underside of a horizontal surface 160 to be cleaned is shown. Surface 160 can be the underside of a ship hull or other similar horizontal surface. The blast unit 4 is constructed substantially the same as the blast unit previously described with reference to FIGS. 1 and 2 except that the blast wheel 6 is arranged to blast or project the abrasive vertically upward against surface 160 rather than horizontally against a vertical surface.

Blast unit 4 is supported for horizontal reciprocating movement in the same manner as the embodiment of FIGS. 1 and 2. In summary, pulley wheels 58 and 60 ride on rail 56 to support blast unit 4. A fluid cylinder 66 has its piston (not shown) connected to the blast unit 4 by cables 68 and 70. This arrangement operates as previously described with reference to FIGS. 1 and 2 to reciprocate the blast unit 4 perpendicular to its direction of travel over surface 160.

To support the blast unit 4 beneath surface 160, the cable suspension system of the previously described embodiments is replaced by driven support cart 162. Support cart 162 consists of a frame 164 supported on wheels 166 that ride on the ground, dry dock floor or other surface 167. While only two wheels are shown, it is to be understood that frame 164 is preferably supported on four wheels. The wheels are driven by a suitable remote controlled hydraulic or electric motor such that the cart is driven below surface 160 in a direction perpendicular to the direction of oscillation of blast unit 4.

Figure 15:
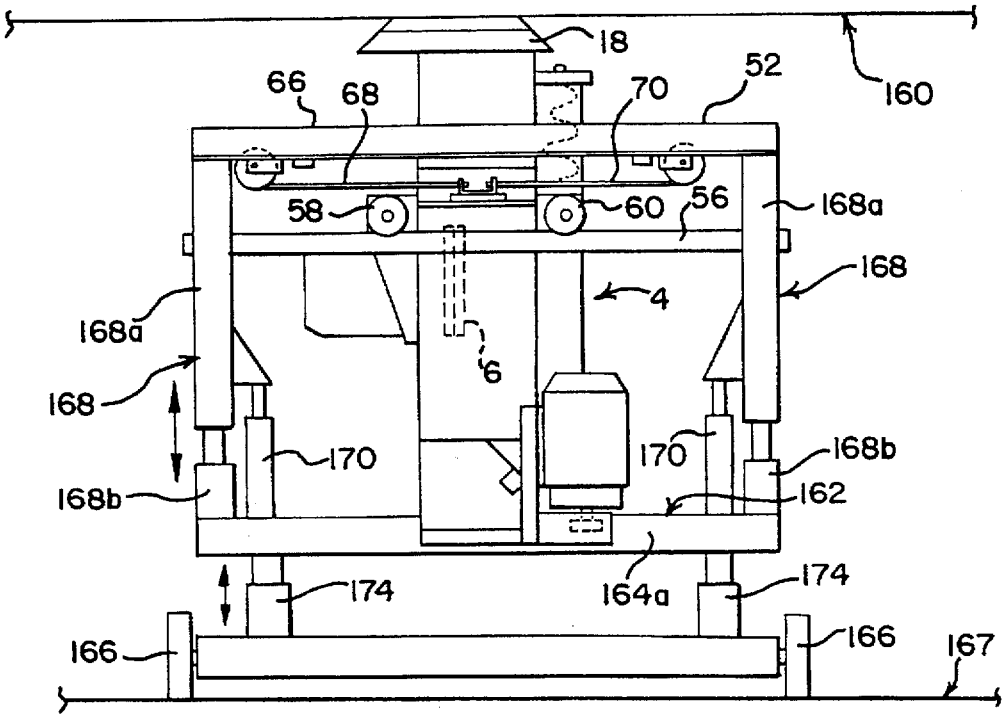
FIG. 15 is a modification of the apparatus of FIG. 14.

Frame 164 supports posts 168 that in turn support rail 56 and cross member 52. While only two posts are shown, it will be appreciated that four posts are preferred to provide a more stable structure. Each post 168 includes an upper section **168*a* and a lower section 168*b*. Sections 168*a* and 168*b* are slidable relative to one another such that the effective height of posts 168 can be changed. A biasing means is provided to adjust the height of posts 168 to maintain a predetermined pressure between the flexible seal 18 and the surface 160. In a preferred embodiment a hydraulic cylinder 170 is connected between frame 164 and each upper post section 168*a* to vertically adjust the position of section 168*a* relative to section 168*b*. A proximity sensor 172 can be provided to control cylinders 170 to maintain a desired pressure between seal 18 and surface 160. Other means such as a pneumatic cylinder, electric motor or similar device can be used if desired. It is further contemplated that a second set of cylinders 174 can be used to move the entire frame 164 vertically to provide gross adjustment and that cylinders 170 can be used to move the post sections 168*a* to provide fine adjustment as best shown in FIG. 15**.

Figure 16:
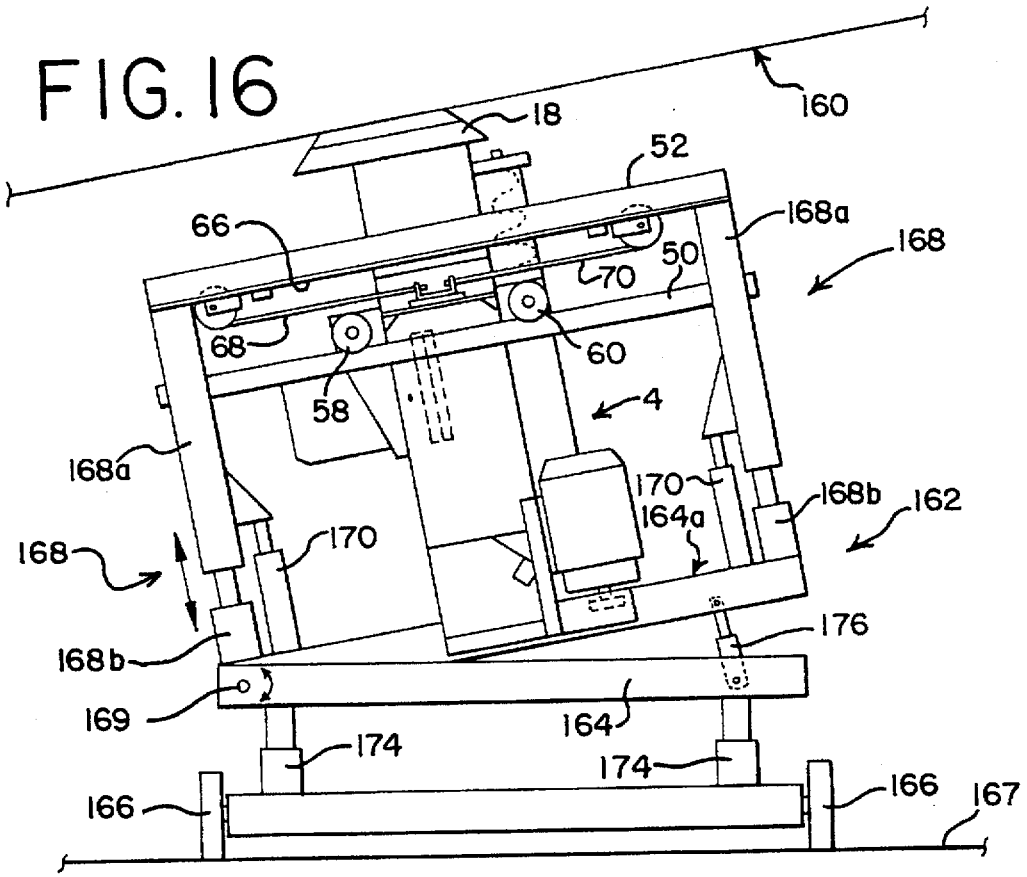
FIG. 16 is another modification of the apparatus of FIG. 14.

Referring to FIG. 16, a subassembly **164*a* of frame 164 that supports posts 168 can be made to pivot along an axis 169 arranged parallel to the direction of travel of the frame to orient the blast unit 4 at an angle relative to the horizontal. Such a pivoting arrangement will allow the machine to be used to clean the bottom of surfaces that are at an angle relative to the horizontal as shown such as are commonly found on the bottom of ship hulls. A fluid cylinder 176 or other similar driving mechanism can be used to pivot subassembly 164*a* relative to frame 164**.

In operation, wheels 166 are driven to move the entire apparatus along the length of surface 160. As the apparatus traverses the surface, blast unit 4 is oscillated to clean a band of surface 160 as wide as the extent of oscillation of the blast unit.

Figure 17:
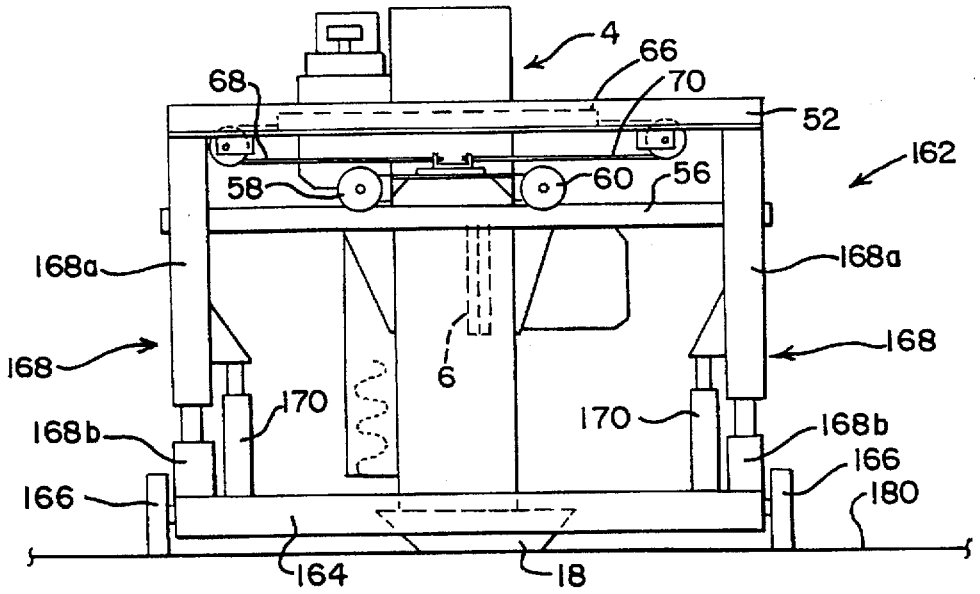
FIG. 17 is another embodiment of a blast cleaning apparatus employing the principles of the invention.

Referring more particularly to FIG. 17, an embodiment showing the blast cleaner of the invention arranged for cleaning a substantially horizontal surface 180 is shown. Surface 180 can be at an angle relative to horizontal provided that the blast machine can traverse the surface. Blast unit 4 is constructed similarly to the blast unit previously described with reference to FIGS. 1 and 2 except that blast wheel 6 is arranged to project abrasive downward against surface 180.

Blast unit 4 is supported for horizontal reciprocating movement in substantially the same manner as the embodiment of FIGS. 1 and 2. In summary, pulley wheels 58 and 60 ride on rail 56 to support blast unit 4. A fluid cylinder 66 has its piston (not shown) connect to blast unit 4 by cables 68 and 70. This arrangement operates as previously described to reciprocate blast unit 4 perpendicular to its direction of travel over surface 180.

To support the blast unit 4 on surface 180, the support cart 162 as previously described with reference to FIG. 14 is used, where like reference numerals are used in FIG. 17 to identify like components previously described with reference to FIG. 14. Support cart 162 consists of a frame 164 supported on wheels 166 that ride on the ground, dry dock floor or other surface 167. While only two wheels are shown, it is to be understood that frame 164 is preferably supported on four wheels. The wheels are driven by a suitable remote controlled hydraulic or electric motor such that the cart is driven below surface 160 in a direction perpendicular to the direction of oscillation of blast unit 4.

Frame 164 supports posts 168 that in turn support rail 56 and cross member 52. While only two posts are shown, it will be appreciated that four posts are preferred to provide a more stable structure. Each post 168 includes an upper section **168*a* and a lower section 168*b*. Sections 168*a* and 168*b* are slidable relative to one another such that the effective height of posts 168 can be changed. A biasing means is provided to adjust the height of posts 168 to maintain a predetermined pressure between the flexible seal 18 and the surface 160. In a preferred embodiment a hydraulic cylinder 170 is connected between frame 164 and each upper post section 168*a* to vertically adjust the position of section 168*a* relative to section 168*b*. A proximity sensor 172 can be provided to control cylinders 170 to maintain a desired pressure between seals 172 and surface 16*a***. Other means such as a pneumatic cylinder, electric motor or similar device can be used if desired.

In the blast cleaning apparatus of the invention, the axis of rotation of the blast wheel is arranged perpendicular to the direction of travel of the apparatus over the surface and parallel to the direction of oscillation. Such an orientation of the blast wheel in combination with the oscillating movement of the blast unit creates a sharp line of demarcation between the cleaned area of the surface and the uncleaned area. As a result, minimal overlap of adjacent passes of the blast unit is required and a more efficient cleaning process results. Moreover, the blast cleaning apparatus of the invention, due to the oscillation of the unit, cleans a wide path of surface when compared to the size of the blast wheel. Thus, a surface treated with the oscillating blast machine of the invention is efficiently cleaned or treated uniformly over the entire surface.

While the invention has been described in some detail with respect to the drawings, it will be appreciated that numerous changes in the details and construction of the invention can be made without departing from the spirit and scope of the invention.

What is claimed is:

1. An apparatus for cleaning a horizontal or inclined surface comprising:

a) blast means for delivering cleaning material to the surface;

b) a housing for containing the blast means; and c) a carriage for supporting the housing, the carriage being movable in a first, generally horizontal direction;

d) a support rail for supporting the housing for traversing movement in a second direction, substantially perpendicular to the first direction, with respect to the carriage;

e) means for reciprocating the housing on the support rail; and f) means for adjusting the orientation of the support rail such that the angle of the support rail and the traversing movement of the housing, relative to the horizontal, may be adjusted to permit cleaning of the inclined surface.

2. The apparatus of claim 1, wherein the means for adjusting comprises at least one fluid cylinder connected between the support rail and the carriage such that the support rail may be angled with respect to the horizontal.

3. The apparatus of claim 1, wherein the housing further comprises a seal for engaging the surface, and means for sensing the proximity of the housing to the surface, the means for sensing cooperating with the means for adjusting to maintain a desired pressure between the seal and the surface.

4. The apparatus of claim 1, wherein the housing is provided with at least one roller for engaging the rail member.

5. The apparatus of claim 4, wherein the roller is provided with a surface shaped for engaging the rail member.

6. The apparatus of claim 5, wherein the support rail is round in cross-section and the roller is provided with a shape for complementarily receiving the rail member.

7. An apparatus for blast cleaning a horizontal or inclined surface while traveling across a ground area underneath the horizontal or inclined surface, the apparatus comprising:

a) a blast wheel for delivering cleaning material to the surface;

b) a housing for containing the blast wheel;

c) frame having a plurality of wheels for traveling across the ground area;

d) rail member for supporting the housing for movement on the frame;

e) means for reciprocating the housing on the rail member; and f) means for adjusting the orientation of the rail member, whereby the rail member may be adjusted to permit the housing to traverse along the inclined surface.

8. The apparatus of claim 7, wherein the means for adjusting comprises at least one fluid cylinder connected between the rail member and the frame such that the rail member may be angled with respect to the frame.

9. The apparatus of claim 7, wherein the housing further comprises a seal for engaging the surface, and means for sensing the proximity of the housing to the surface, the means for sensing cooperating with the means for adjusting to maintain a desired pressure between the seal and the surface.

10. The apparatus of claim 7, wherein the housing is provided with at least one roller for engaging the rail member.

11. The apparatus of claim 10, wherein the roller is provided with a surface shaped for engaging the rail member.

12. The apparatus of claim 11, wherein the rail member is round in cross-section and the roller is provided with a shape for complementarily receiving the rail member.

* * * * *

UNITED STATES PATENT AND TRADEMARK OFFICE

CERTIFICATE OF CORRECTION

PATENT NO. : 5,730,646

DATED : March 24, 1998

INVENTOR(S) : Robert B. Watkin

It is certified that error appears in the above-indentified patent and that said Letters Patent is hereby corrected as shown below:

Claim 7, Column 10, line 16, "frame" should read -- a frame --.

Claim 7, Column 10, line 18, "rail member" should read -- a rail member --.

Signed and Sealed this

Seventh Day of July, 1998

Bruce Lehman

*Attest:*

BRUCE LEHMAN

*Attesting Officer*

*Commissioner of Patents and Trademarks*